US011740035B2

(12) United States Patent
Morimine

(10) Patent No.: US 11,740,035 B2
(45) Date of Patent: Aug. 29, 2023

(54) COOLING DEVICE AND MANUFACTURING METHOD FOR COOLING DEVICES

(71) Applicant: NEC Platforms, Ltd., Kawasaki (JP)

(72) Inventor: Shinya Morimine, Kanagawa (JP)

(73) Assignee: NEC Platforms, Ltd., Kanagawa (JP)

( * ) Notice: Subject to any disclaimer, the term of this patent is extended or adjusted under 35 U.S.C. 154(b) by 252 days.

(21) Appl. No.: 17/312,461

(22) PCT Filed: Dec. 19, 2019

(86) PCT No.: PCT/JP2019/049878
§ 371 (c)(1),
(2) Date: Jun. 10, 2021

(87) PCT Pub. No.: WO2020/137822
PCT Pub. Date: Jul. 2, 2020

(65) Prior Publication Data

US 2022/0057149 A1 Feb. 24, 2022

(30) Foreign Application Priority Data

Dec. 26, 2018 (JP) ..... 2018-242159

(51) Int. Cl.
*F28F 9/00* (2006.01)
*F28D 15/02* (2006.01)

(52) U.S. Cl.
CPC ..... *F28F 9/005* (2013.01); *F28D 15/0266* (2013.01); *F28D 2015/0216* (2013.01); *F28F 2240/00* (2013.01)

(58) Field of Classification Search
CPC ... F28F 9/005; F28F 2240/00; F28D 15/0266; F28D 2015/0216; F28D 15/02
(Continued)

(56) References Cited

U.S. PATENT DOCUMENTS

2009/0084525 A1* 4/2009 Satou ..... H01L 23/427 165/104.21
2011/0214840 A1* 9/2011 Sakamoto ..... F28D 15/0266 165/104.21
(Continued)

FOREIGN PATENT DOCUMENTS

JP 2005321152 A * 11/2005 ..... F28D 15/02
JP 2005321152 A 11/2005
(Continued)

OTHER PUBLICATIONS

International Search Report of PCT Application No. PCT/JP2019/049878 dated Mar. 10, 2020.
(Continued)

*Primary Examiner* — Justin M Jonaitis
(74) *Attorney, Agent, or Firm* — Sughrue Mion, PLLC

(57) ABSTRACT

A cooling device has a heat receiving unit that has a space therein, liquid phase piping that supplies liquid phase refrigerant to the heat receiving unit, gas phase piping that discharges gas phase refrigerant from the heat receiving unit, and spacers that are disposed inside the heat receiving unit. The spacers have a higher specific gravity than the liquid phase refrigerant. The spacers have a shape allowing movement along the bottom face of the heat receiving unit. When the heat receiving unit tilts, the spacers move to the low side of the heat receiving unit. The spacers gather on the bottom face of the heat receiving unit on the low side. The liquid phase refrigerant spreads to the high side of the heat receiving unit by an amount equivalent to the volume removed due to the spacers, and uniform cooling can be performed.

20 Claims, 13 Drawing Sheets

(58) Field of Classification Search
USPC ..... 165/104.21
See application file for complete search history.

(56) References Cited

U.S. PATENT DOCUMENTS

| | | | | |
|---|---|---|---|---|
| 2012/0180993 | A1 | 7/2012 | Yoshikawa et al. | |
| 2015/0241096 | A1* | 8/2015 | Matsunaga | F25B 39/028 29/890.035 |
| 2019/0186843 | A1* | 6/2019 | Takeuchi | F28D 15/0266 |

FOREIGN PATENT DOCUMENTS

| | | | |
|---|---|---|---|
| JP | 2009088125 | A | 4/2009 |
| JP | 2012233625 | A | 11/2012 |
| JP | 2018115858 | A | 7/2018 |
| KR | 101305437 | B1 | 9/2013 |
| WO | 2010058520 | A1 | 5/2010 |
| WO | 2011040129 | A1 | 4/2011 |
| WO | 2018047529 | A1 | 3/2018 |

OTHER PUBLICATIONS

English translation of Written opinion for PCT Application No. PCT/JP2019/049878 dated Mar. 10, 2020.

* cited by examiner

COOLING DEVICE AND MANUFACTURING METHOD FOR COOLING DEVICES

This application is a National Stage Entry of PCT/JP2019/049878 filed on Dec. 19, 2019, which claims priority from Japanese Patent Application 2018-242159 filed on Dec. 26, 2018, the contents of all of which are incorporated herein by reference, in their entirety.

TECHNICAL FIELD

The present invention relates to a cooling device and a manufacturing method for the cooling device.

BACKGROUND ART

In recent years, a large amount of heat has come to be generated in semiconductors and electronic devices with advanced high performance and high miniaturization. In order to prevent failure of these devices and the like and to perform stable operation, it is necessary to quickly cool the large amount of heat. As a means for cooling an electronic component having such a high heat generation density, a cooling device (hereinafter referred to as a "phase change cooling device") that transports, diffuses, and cools heat by using a phase change of a refrigerant is being considered.

A general phase change cooling device comprises a heat receiving unit that receives heat of a heating element composed of an electronic component such as a CPU, a heat radiating unit that radiates heat transported by utilizing a phase change of a refrigerant, and a piping that connects the heat receiving unit and the heat radiating unit. A liquid phase refrigerant is supplied from a liquid pipe to the heat receiving unit, and the liquid phase refrigerant boils by heat received from the heating element and thereby becomes a gas phase refrigerant. At this time, heat equivalent to evaporation heat is absorbed, and the heat receiving unit is cooled. The generated gas phase refrigerant is discharged from a gas phase pipe, moves to the heat radiating unit, and releases heat in the heat radiating unit and liquefies. The liquefied liquid phase refrigerant returns to the liquid pipe and is supplied to the heat receiving unit again. By such an operation, in the phase change cooling device, the refrigerant can be circulated without using a pump, and the heat receiving unit can be cooled.

An example of the phase change cooling device as described above is disclosed in, for example, PTL 1. The cooling device in PTL 1 comprises: an evaporator provided with a heat receiving unit in close contact with an electronic component or the like. The cooling device also comprises a liquid pipe that supplies a working liquid (refrigerant) to the evaporator; a vapor pipe that discharges refrigerant vapor generated in the evaporator. The cooling device also comprises a plate-like porous wick that separates a space inside the evaporator into a side of the liquid pipe and a side of the vapor pipe. The refrigerant flowing from the liquid pipe into the evaporator moves in a thickness direction of the wick due to capillary phenomenon, and evaporates by heat received from an electronic component or the like. At this time, heat equivalent to evaporation heat is absorbed, and the heat receiving unit is cooled. In this cooling device, the evaporator is made thinner by forming the wick into a plate shape.

CITATION LIST

[Patent Literature]

[PTL 1] Japanese Unexamined Patent Application Publication No. 2012-233625

SUMMARY OF INVENTION

[Technical Problem]

However, in the general cooling device as in PTL 1, when the cooling device tilts, there is a problem that the heat receiving unit cannot be uniformly cooled. When the cooling device tilts, the liquid phase refrigerant is biased toward a low side and is not supplied to a high side. As a result, cooling is not sufficiently performed on the high side of the tilted cooling device, and thus cooling efficiency of the cooling device is lowered.

The present invention has been made in view of the above-mentioned problems, and an object of the present invention is to provide a cooling device capable of reducing a decrease in cooling efficiency due to atilt of the cooling device.

[Solution to Problem]

In order to solve the above-mentioned problems, the cooling device comprises: a heat receiving unit having a space therein; a liquid phase piping that supplies a liquid phase refrigerant to the heat receiving unit; a gas phase piping that discharges a gas phase refrigerant from the heat receiving unit; and a spacer disposed inside the heat receiving unit. The spacer has a higher specific gravity than the liquid phase refrigerant. The spacer has a shape that can move along a bottom surface of the heat receiver. When the heat receiving unit tilts, the spacer moves to a low side of the heat receiver. Herein, since the spacer has a higher specific gravity than the liquid phase refrigerant 2, the spacer collects on the bottom surface on the low side of the heat receiver. The liquid phase refrigerant spreads to a high side of the heat receiver by an amount equivalent to a volume removed by the spacer, and thus cooling with high uniformity can be performed.

[Advantageous Effects of Invention]

An advantageous effect of the present invention is that it is possible to provide a cooling device capable of reducing a decrease in cooling efficiency due to a tilt of the cooling device.

EXAMPLE EMBODIMENT

Figure 1:
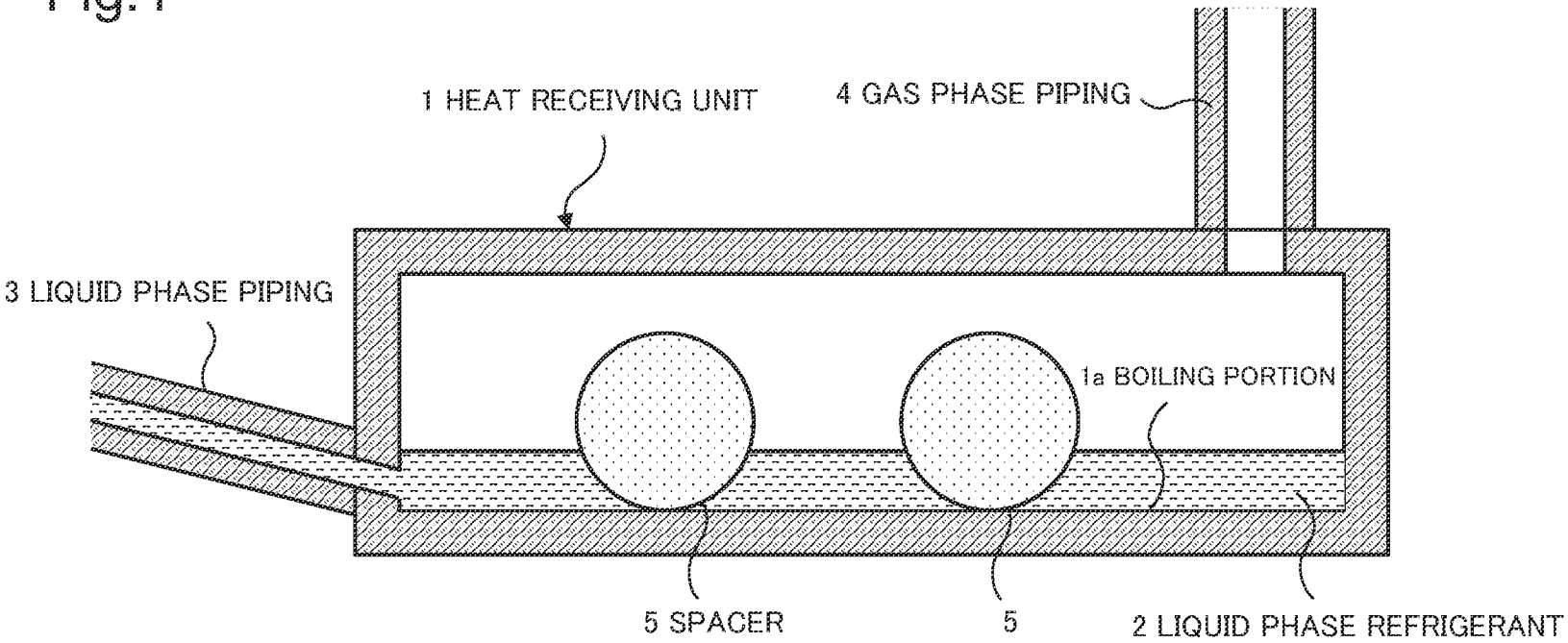
FIG. 1 is a cross-sectional view illustrating a cooling device according to a first example embodiment.

Hereinafter, with reference to the drawings, example embodiments of the present invention will be described in detail. However, although technically desirable limitation is made to the example embodiments to be described below for achieving the present invention, the scope of the invention is not limited to the following. Note that similar components in the drawings are denoted by the same reference numerals, and a description thereof may be omitted.

First Example Embodiment

FIG. 1 is a cross-sectional view illustrating a cooling device according to the present example embodiment. The cooling device comprises a heat receiving unit 1 having a space for holding a liquid phase refrigerant therein, a liquid phase piping 3 that supplies a liquid phase refrigerant 2 to the heat receiving unit 1. The cooling device also comprises a gas phase piping 4 that discharges a gas phase refrigerant from the heat receiving unit 1, and a spacer 5 disposed inside the heat receiving unit 1. The spacer 5 has a specific gravity higher than the liquid phase refrigerant 2. The spacer 5 is freely movable inside the heat receiver 1. In the example of FIG. 1, the spacer 5 has a spherical shape, but may have another shape such as an ellipsoid or a polyhedron.

When the heat receiving unit 1 receives heat, the liquid phase refrigerant 2 boils in a boiling portion la being a bottom surface of the inside of the heat receiving unit, and is discharged from the gas phase piping 4. At this time, evaporation heat of the liquid phase refrigerant 2 is consumed, and thus the heat receiving unit 1 is cooled.

Figure 2:
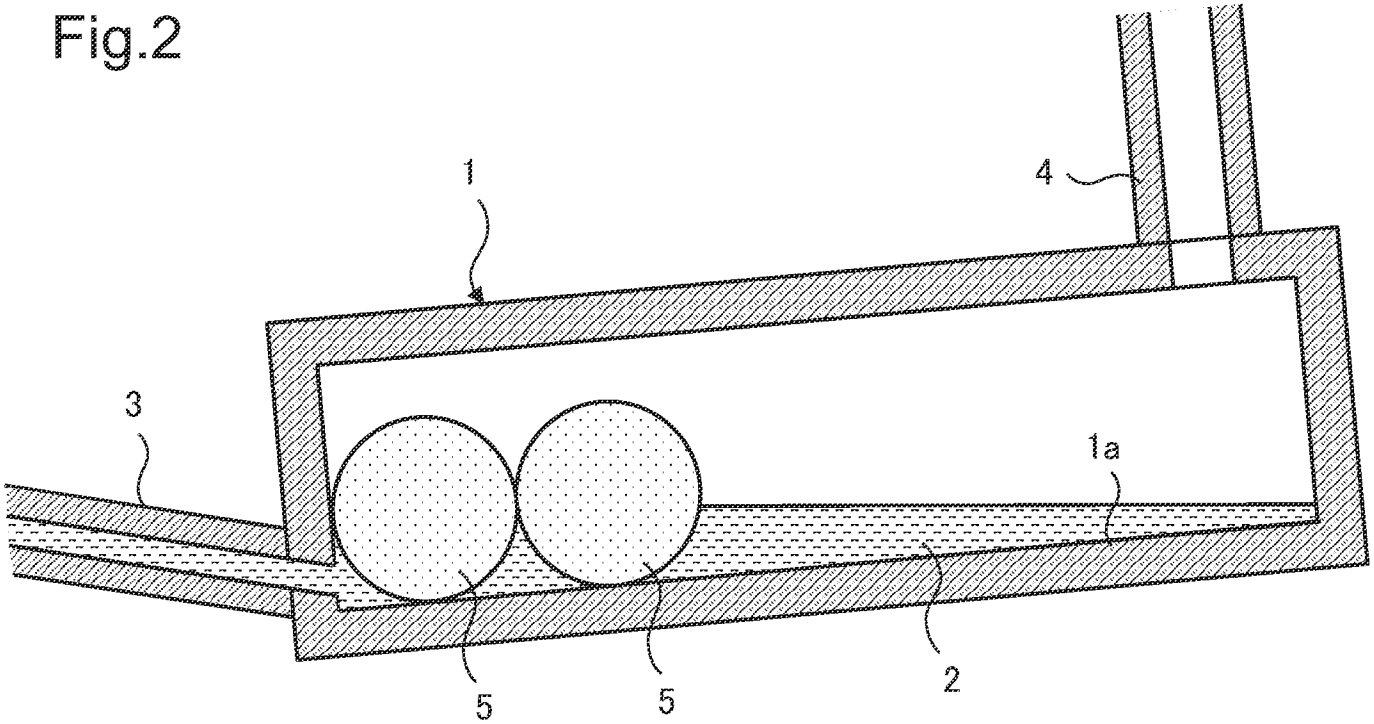
FIG. 2 is a cross-sectional view illustrating a state in which the cooling device according to the first example embodiment is tilted.

FIG. 2 is a cross-sectional view illustrating a state in which the cooling device 1 is tilted. When the cooling device 1 tilts, the spacer 5 moves to a low side of the heat receiver 1. Herein, since the spacer 5 has a higher specific gravity than the liquid phase refrigerant 2, the spacer 5 collects on the bottom surface on the low side of the heat receiver 1. The liquid phase refrigerant 2 expands to a high side of the heat receiver 1 by an amount equivalent to a volume removed by the spacer 5. Due to this expansion, the liquid phase refrigerant 2 reaches the high side of the heat receiver 1, and thus it is possible to make it difficult for a bias to occur in cooling of the boiling portion 1*a*.

As described above, according to the present example embodiment, it is possible to reduce a decrease in cooling efficiency when the cooling device is tilted.

Second Example Embodiment

Figure 3:
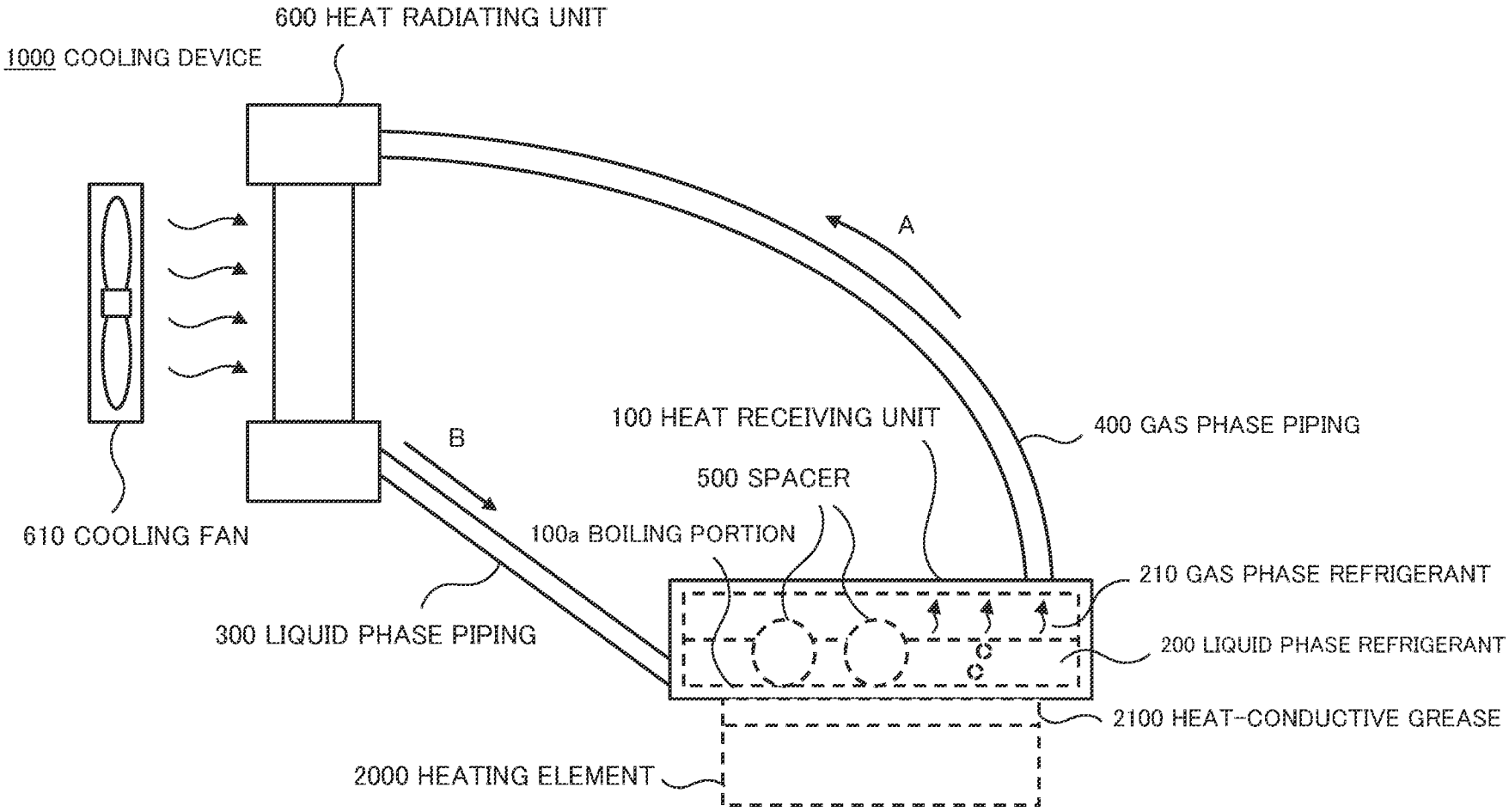
FIG. 3 is a schematic side view illustrating an entire cooling device according to a second example embodiment.

FIG. 3 is a schematic side view illustrating a cooling device 1000 according to the second example embodiment. The cooling device 1000 comprises a heat receiving unit 100, a liquid phase piping 300, a gas phase piping 400, and a heat radiating unit 600, which are combined to form a closed flow path. In the closed flow path, a refrigerant, which performs cooling by means of heat received by the heat receiving unit 100 causing a phase change from a liquid phase to a gas phase, is enclosed. A spacer 500 partially immersed in a liquid phase refrigerant 200 is disposed inside the heat receiving unit 100, and in the example of FIG. 3, a heat conductive grease 2100 is disposed between a heating element 2000 and the heat receiving unit 100, which enhances thermal conductivity between the two. In the example of FIG. 3, the heating element 2000 may be an electronic component such as a central processing unit (CPU), for example, but is not limited thereto, and may be generally applied to a heat-generating element.

Next, an operation of cooling and circulation of the refrigerant will be described. The liquid phase refrigerant 200 is supplied from the liquid phase piping 300 to the heat receiving unit 100 by utilizing an action of gravity.

In a boiling portion 100*a* being a lower surface of the heat receiving unit 100, the liquid phase refrigerant 200 inside boils by heat conducted from the heating element 2000, which changes the phase of the liquid-phase refrigerant 200 to the phase of the gas phase refrigerant 210. When the liquid phase refrigerant 200 is phase-changed to the gas phase refrigerant 210, heat is absorbed in the refrigerant as latent heat. Since a density of the gas phase refrigerant 210 is smaller than that of the liquid phase refrigerant 200, the gas phase refrigerant 210 rises by buoyancy thereof, and passes through the gas phase piping 400 and moves to the heat radiating unit 600 as indicated by an arrow A. In order to move the gas phase refrigerant 210 to the heat radiating unit 600 by utilizing buoyancy, the heat radiating unit 600 needs to be vertically above the heat receiving unit 100.

The heat radiating unit 600 utilizes a cooler such as a cooling fan 610 and promotes heat radiation from the heat radiating unit 600 into the air. The gas phase refrigerant 210 that moves to the heat radiating unit 600 radiates heat thereof into the air by, for example, cooling air sent from the cooling fan 610, and changes the phase to the liquid phase refrigerant 200. Since a density of the liquid phase refrigerant 200 is higher than that of the gas phase refrigerant 210, the liquid phase refrigerant 200 drops by gravity, passes through the liquid phase piping 300, and is refluxed to the heat receiving unit 100 as indicated by an arrow B. The refluxed liquid phase refrigerant 200 receives heat from the heating element 2000 and is utilized again for circulation of the refrigerant.

In this manner, the cooling device 1000 can circulate the liquid phase refrigerant 200 and the gas phase refrigerant 210 without using a pump by utilizing the phase change of the refrigerant. In addition, an amount of heat that can be transported by phase change per unit mass is several hundred times larger than that of a system in which heat is transported by an increase in temperature of a refrigerant, such as water cooling, and is therefore suitable for heat transport and cooling with a high amount of heat generation.

Figure 4:
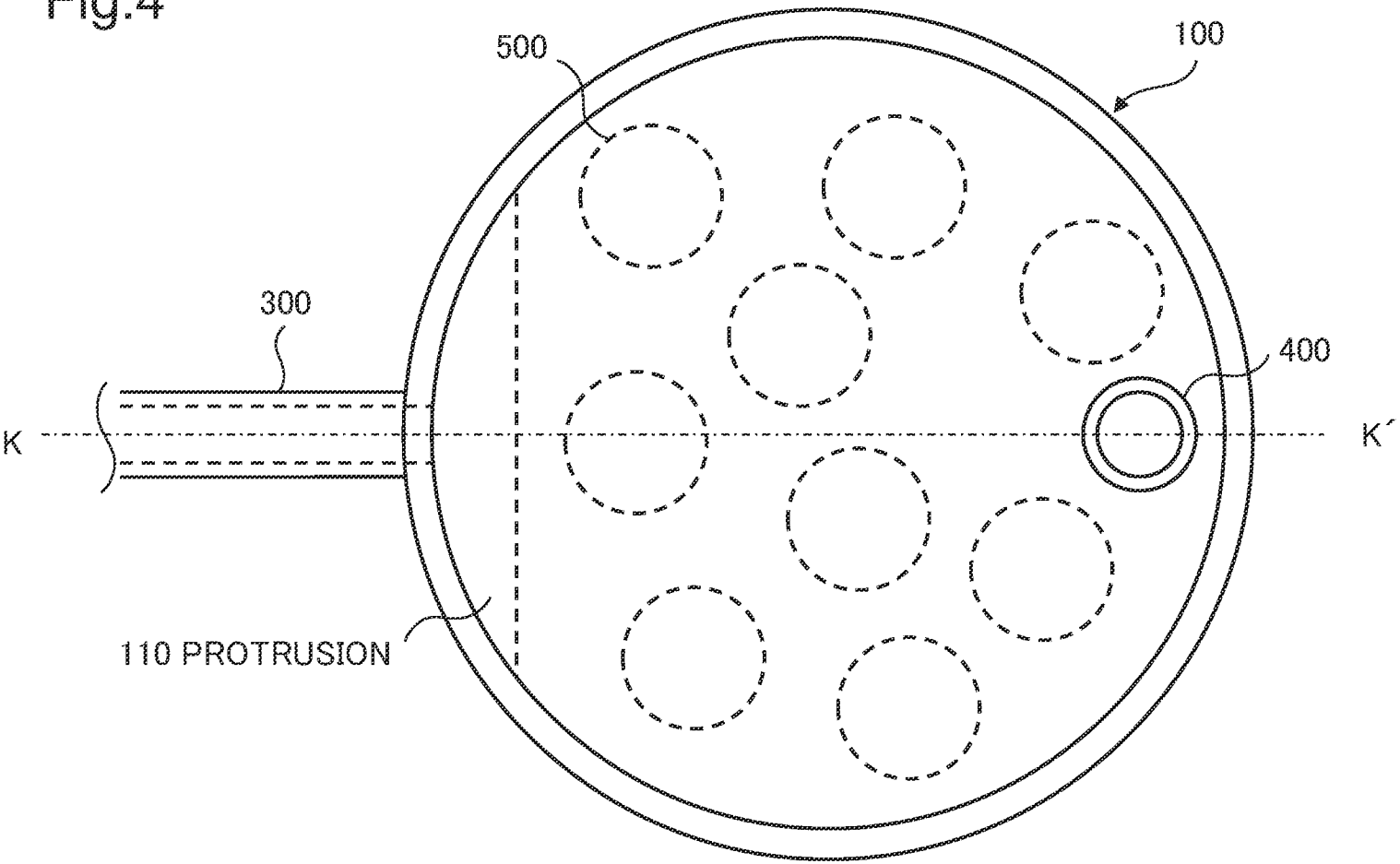
FIG. 4 is a plan view illustrating a heat receiving unit according to the second example embodiment.

Next, a configuration of the heat receiving unit 100 according to the present example embodiment will be described. FIG. 4 is a plan view illustrating the heat receiving unit 100 in a horizontal state. As illustrated in FIG. 4, a plurality of spacers 500 are enclosed in the heat receiving unit 100. In the horizontal state, each of the spacers 500 assumes a random position. Herein, it is assumed that the spacer 500 has a spherical shape. Further, in this example, it is assumed that an internal space of the heat receiving unit 100 has a cylindrical shape. A protrusion 110 is formed in such a way as to have a shape of being connected to an arc of a circle by a straight line when viewed from the upper surface thereof. This makes it possible to increase a volume of the spacer 500 immersed in the liquid phase refrigerant 200 when the heat receiving unit 100 is tilted.

Note that this is an example of the shapes of the heat receiving unit 100 and the protrusion 110, and is not limited thereto. The shapes of the heat receiving unit 100 and the protrusion 110 may be any shape as long as the shape does not hinder movement of the spacer 500 when the tilt changes.

Figure 5:
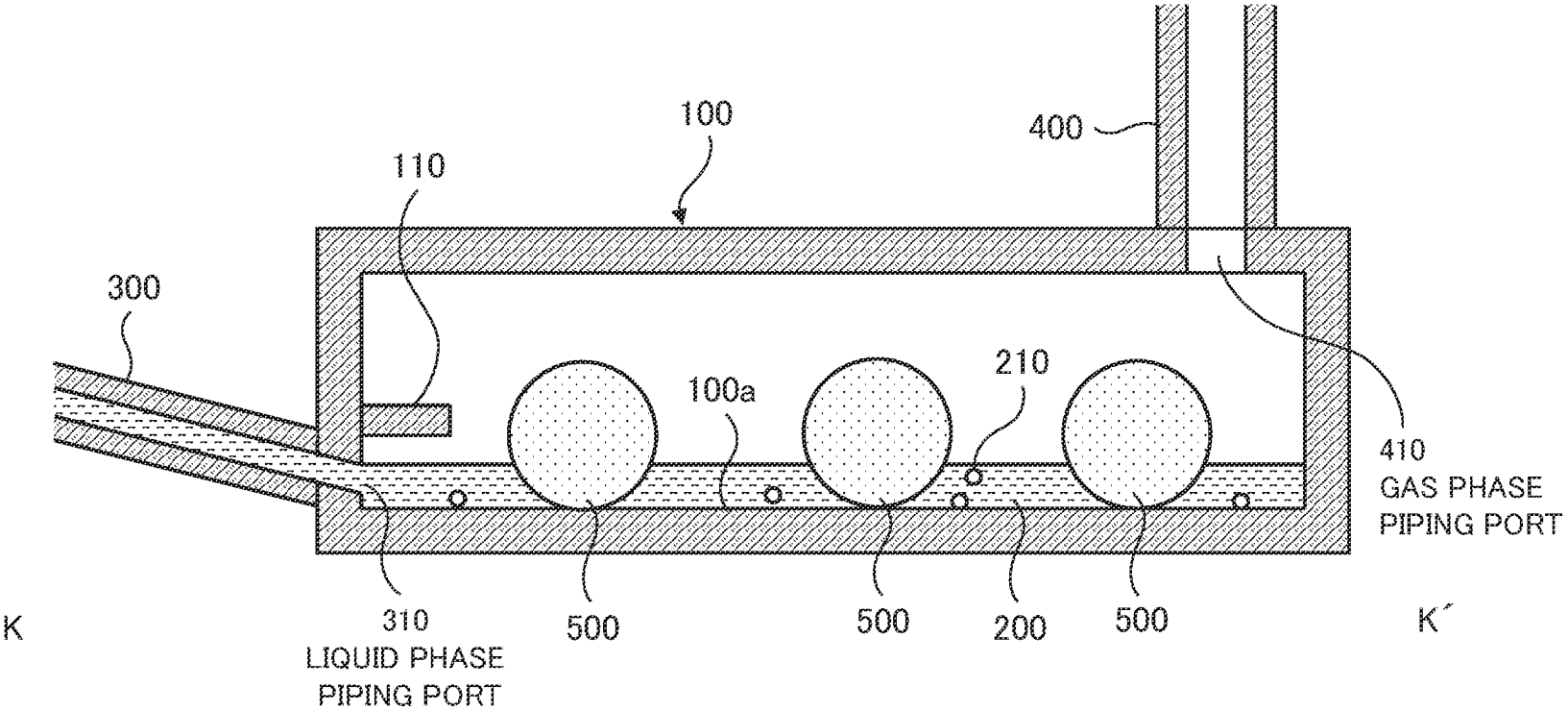
FIG. 5 is a cross-sectional view illustrating a case when the heat receiving unit according to the second example embodiment is in a horizontal state.

FIG. 5 is a cross-sectional view taken along a line K-K' in FIG. 4. As illustrated in FIG. 5, the liquid phase piping 300 is connected to one side surface of the heat receiving unit 100, and the liquid phase refrigerant 200 flows into the heat receiving unit 100 from a liquid phase piping port 310 of the connecting portion. A protrusion 110 is provided on an inner wall of the heat receiving unit 100 above the liquid phase piping port 310. The protrusion 110 restricts movement of the spacer 500 in such a way that the spacer 500 does not block the liquid phase piping port 310. The gas phase piping 400 is connected to an upper portion of the heat receiving unit 100 via a gas phase piping port 410.

The liquid phase refrigerant 200 and the spacer 500 are held inside the heat receiving unit 100. The specific gravity of the spacer 500 is sufficiently higher than that of the liquid phase refrigerant 200, and the spacer does not float on the liquid phase refrigerant 200. The spacer 500 has a spherical shape, and a cross-sectional area becomes smaller as a distance from the center of the spacer 500 increases. Therefore, an amount of the liquid phase refrigerant 200 being present varies depending on its height. When the liquid phase refrigerant 200 is present only at a position lower than the center of the spacer 500, the amount of the liquid phase refrigerant 200 being present is the minimum at the liquid surface, and is the maximum at a position farthest from the center, i.e., at the boiling portion 100*a*. Since the liquid phase refrigerant 200 is phase-changed to the gas phase refrigerant 210 in the boiling portion 100*a*, a large amount of refrigerant is present in the boiling portion 100*a*, whereby the refrigerant can be efficiently utilized.

Figure 6:
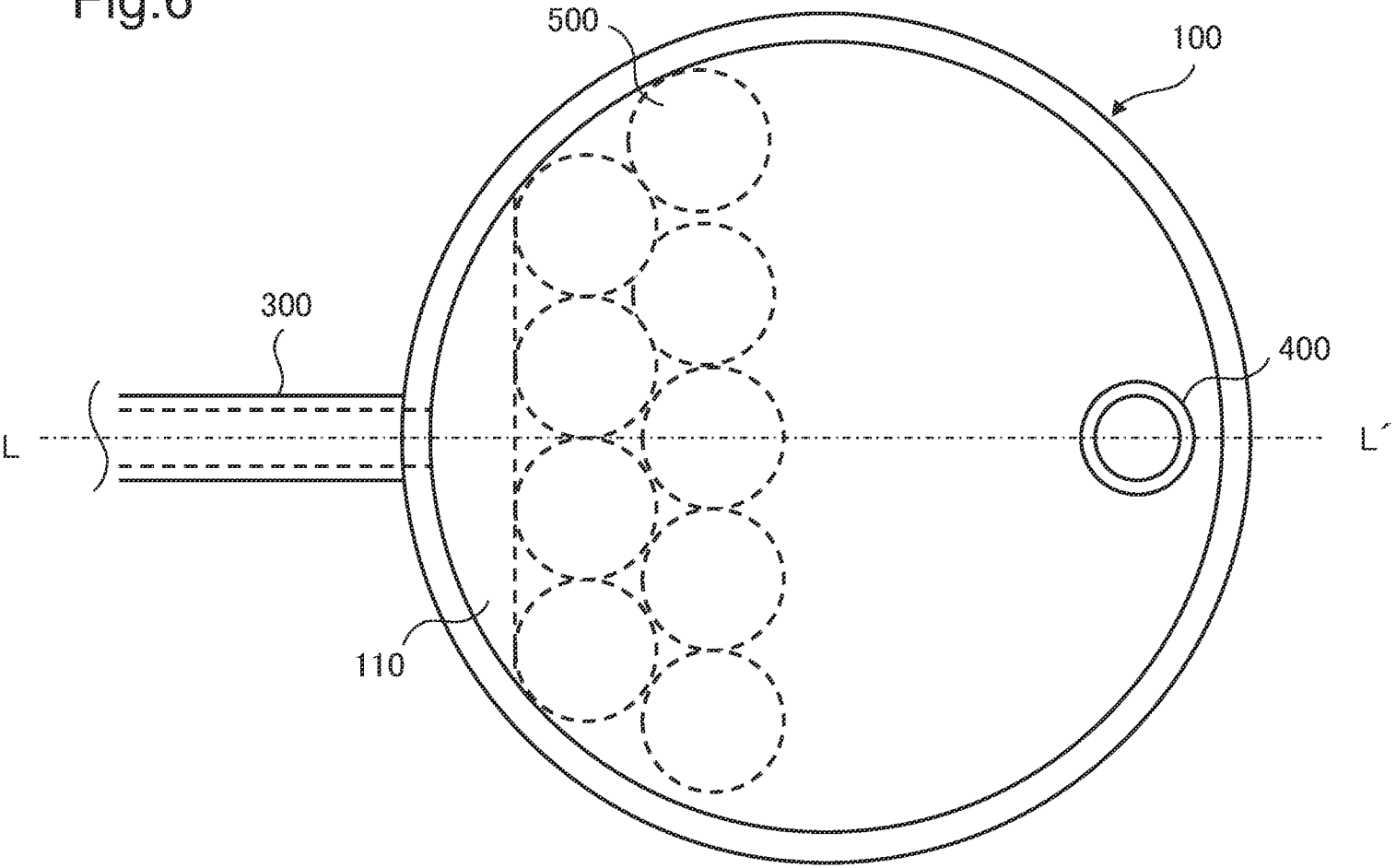
FIG. 6 is a plan view illustrating a state in which the heat receiving unit according to the second example embodiment is tilted.

FIG. 6 is a plan view illustrating a state in which the heat receiving unit 100 is tilted in such a way that a side of the liquid phase piping 300 is lowered. Herein, this state is referred to as being tilted to the lower left. By tilting in this manner, the spacers 500 gather toward the protrusion 110.

Figure 7:
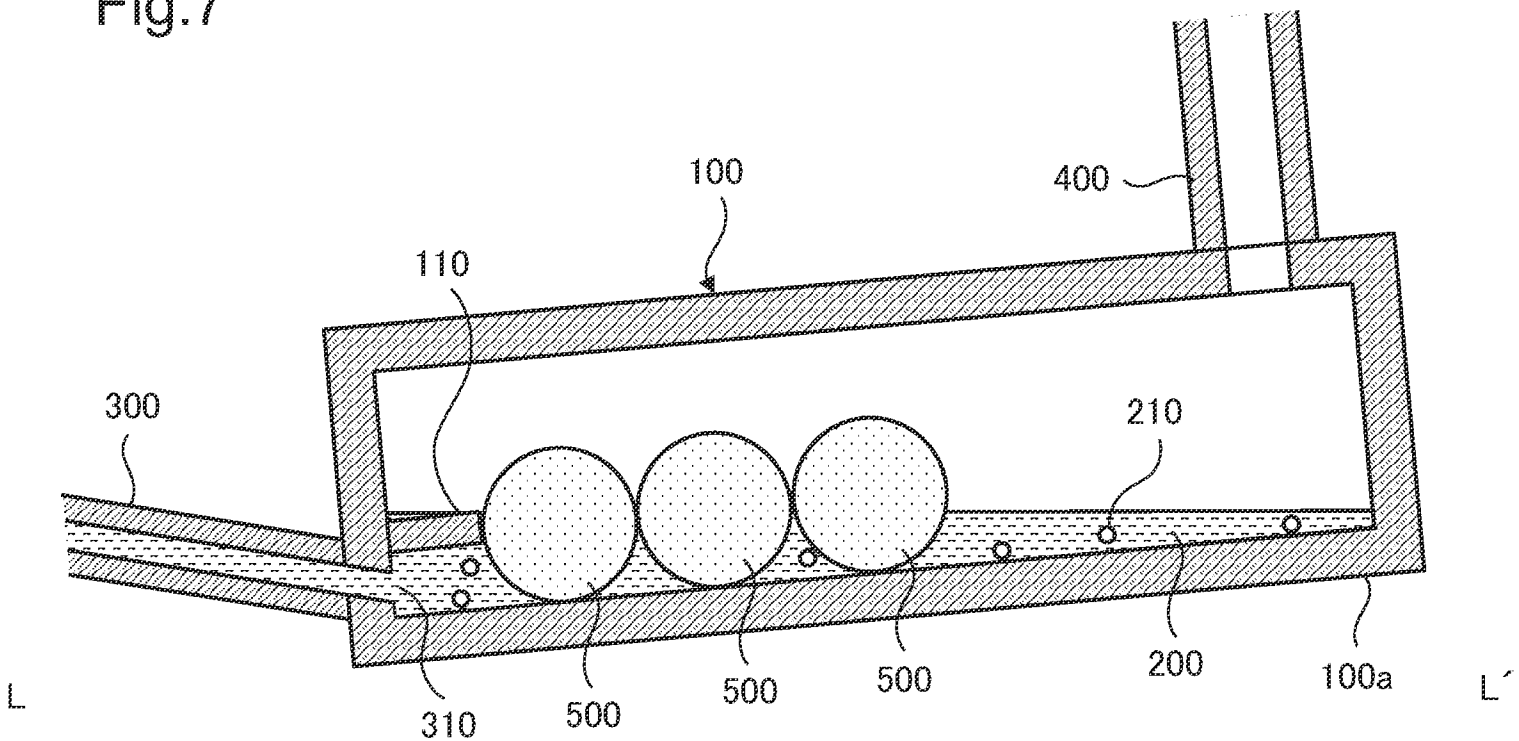
FIG. 7 is a cross-sectional view illustrating a state in which the heat receiving unit according to the second example embodiment is tilted.

FIG. 7 is a cross-sectional view taken along a line L-L' in FIG. 6. The heat receiving unit 100 tilts to the lower left, whereby the liquid phase refrigerant 200 moves to the lower left by gravity. At this time, the spacer 500 also moves to the lower left. In this way, a liquid surface on a side of the liquid phase piping port 310 rises. This rise of the liquid surface is caused not only by the movement of the liquid phase refrigerant 200 due to the tilt, but also by an increase in volume of the spacer 500 immersed in the liquid phase refrigerant. In other words, the liquid phase refrigerant 200 is pushed aside by an increased amount of the volume of the spacer 500 immersed in the liquid phase refrigerant 200, whereby the liquid surface of the liquid phase refrigerant 200 rises. As a result, the liquid phase refrigerant spreads over the boiling portion 100*a* on a side of the gas phase piping 400, which is tilted to the higher side, and the phase change cooling can be performed over the entire boiling portion 100*a*. Although FIG. 7 illustrates an example in which the spacers 500 are linearly arranged along a cutting line for facilitating visual comprehension, the arrangement of the spacers 500 is not limited to this.

The number of the spacers 500 is desirably such that an area occupied by the spacers 500 falls within a range of ¼ to ½ of an area of the bottom surface of the heat receiving unit 100 when viewed from above the heat receiving unit 100. It is desirable that a size of the spacer 500 is such that about ⅓ of the volume of the spacer 500 is immersed in the liquid phase refrigerant 200 when the heat receiving unit 100 is in the horizontal state. This is because a difference in volume in which the spacer 500 is immersed in the liquid phase refrigerant 200 is to be increased between a time of being in the horizontal state illustrated in FIG. 5 and a time of being in the tilted state illustrated in FIG. 7.

Figure 8:
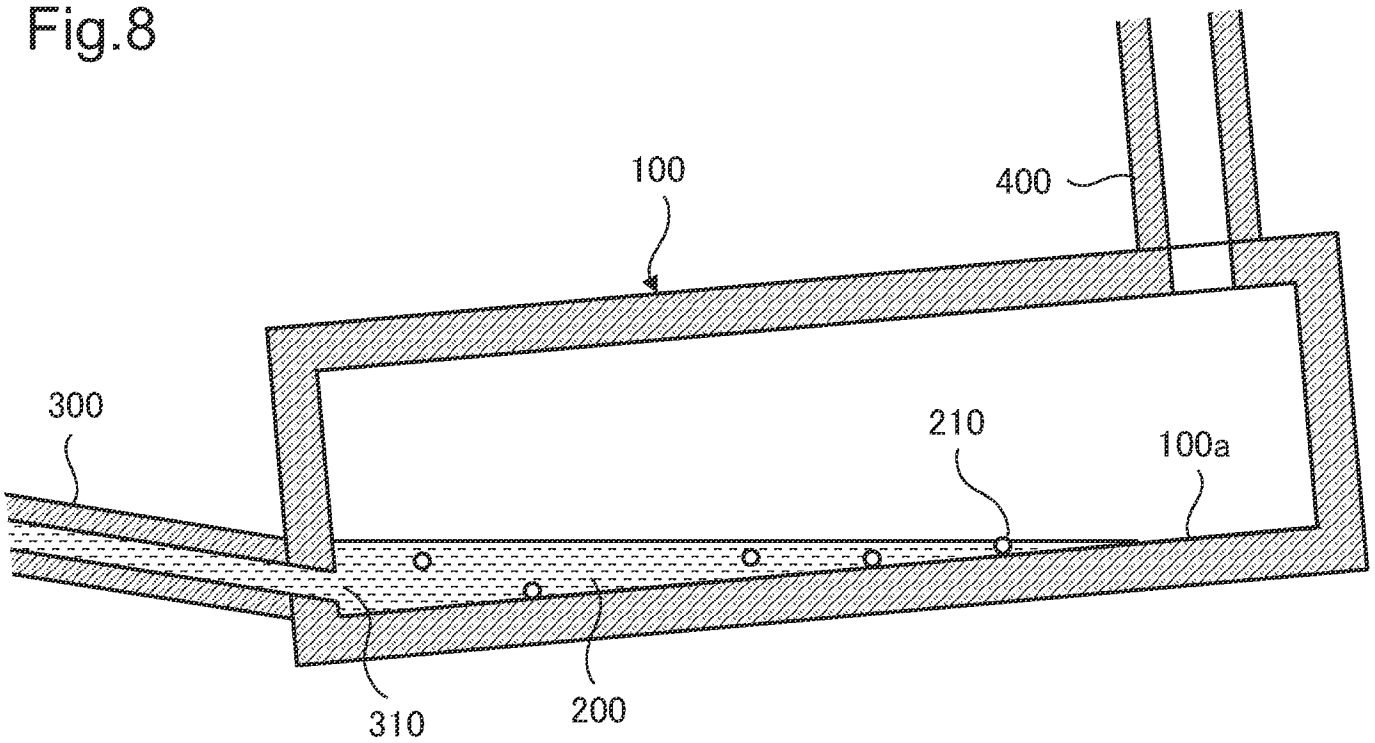
FIG. 8 is a cross-sectional view illustrating a comparative example of the second example embodiment.

Herein, for comparison, a case where the spacer 500 is not provided will be described. FIG. 8 is a cross-sectional view illustrating a heat receiving unit without the spacer 500. In this example, the liquid phase refrigerant 200 does not flow to the boiling portion 100*a* that is tilted toward the higher side, and the boiling portion 100*a* is exposed to a space inside the heat receiving unit 100. Since cooling is not performed in this portion, cooling efficiency of the heating element is lowered.

Figure 9:
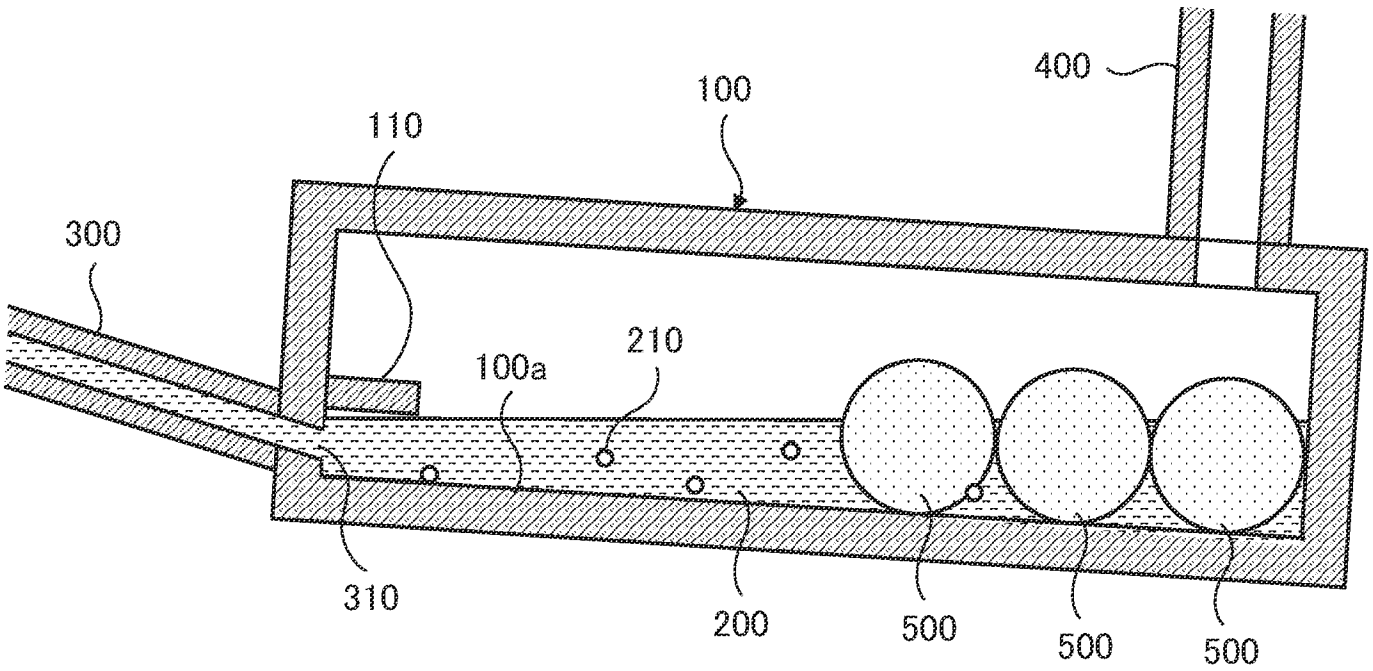
FIG. 9 is a cross-sectional view illustrating a state in which the heat receiving unit according to the second example embodiment is tilted in another direction.

Next, a case of being tilted in a direction in which a side of the liquid phase piping 300 becomes higher will be described. FIG. 9 is a cross-sectional view illustrating a state in which the heat receiving unit 100 is tilted in a direction in which a side of the liquid phase piping port 310 rises. In this case, such a tilted state is also referred to as tilting to the lower right. In a state in which the heat receiving unit 100 is tilted to the lower right, both the liquid phase refrigerant 200 and the spacer 500 move to the lower right. At this time, since there is no protrusion 110 on the right side, the spacer 500 moves until coming into contact with the wall surface. An increase in volume of the spacer 500 that sinks into the liquid phase refrigerant 200 raises the liquid surface of the liquid phase refrigerant 200, and the liquid phase refrigerant 200 spreads to the left side of the boiling portion 100*a*, as in the case of tilting to the lower left. Therefore, the phase of the liquid phase refrigerant 200 can be changed to the phase of the gas phase refrigerant 210 on the entire surface of the boiling portion 100*a*. As a result, a stable cooling state can be maintained with a smaller amount of the liquid phase refrigerant 200 even in the state of tilting to the lower right as in the case of tilting to the lower left.

Figure 10:
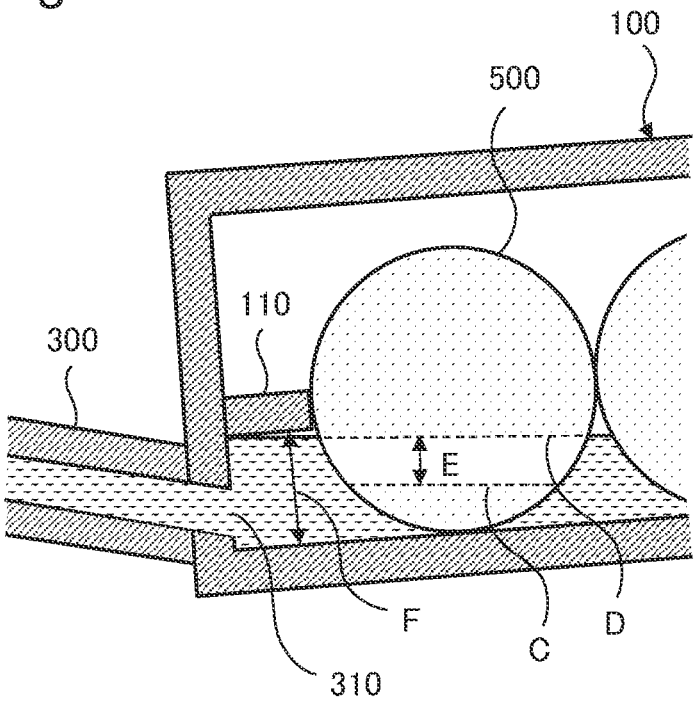
FIG. 10 is a cross-sectional view illustrating a vicinity of a liquid phase piping port according to the second example embodiment.

Next, a description will be given of a rise of the liquid surface when the heat receiving unit 100 is tilted in a direction in which the side of the liquid phase piping 300 is lowered. FIG. 10 is a cross-sectional view illustrating a vicinity of the liquid phase piping port 310 when being tilted as described above. In FIG. 10, a dotted line C in the spacer 500 indicates a position of the liquid surface of the liquid phase refrigerant 200 in the horizontal state. The liquid surface of the liquid phase refrigerant 200 in such a state of being tilted is at a position indicated by a dotted line D. That is, the volume of the spacer 500 immersed in the liquid phase refrigerant 200 increases by an amount equivalent to the difference in the liquid surface of the liquid phase refrigerant 200 being indicated by a double-headed arrow E. Then, the liquid phase refrigerant 200 is pushed aside by the increased amount of the volume, whereby the liquid surface of the liquid phase refrigerant 200 rises. Since the liquid surface of the liquid phase refrigerant 200 rises, even with a smaller amount of the liquid phase refrigerant 200, the phase change cooling can be performed also on the right side of the boiling portion 100*a*. Because the right side of the boiling portion 100*a* can maintain a state of being immersed in the liquid phase refrigerant 200. As a result, a stable cooling state can be maintained even with a small amount of the liquid phase refrigerant 200 by the above-described operation.

Next, the protrusion 110 will be described. In FIG. 10, a height of the protrusion 110 is indicated by a double-headed arrow F. Since the protrusion 110 needs to be in contact with the spacer 500 quickly, F can be, for example, about the same as a radius of the spacer 500. However, when the protrusion 110 affects movement of the refrigerant 200, the protrusion 110 may be placed at a higher position than that. In addition, a size of the protrusion 110 is such that, when the protrusion 110 comes into contact with the spacer 500, a sufficient distance is maintained between the liquid phase piping port 310 and the spacer 500, and inflow of the liquid phase refrigerant 200 is not hindered. With such a configuration, the protrusion 110 restricts movement of the spacer 500, and the spacer 500 does not hinder the inflow of the liquid phase refrigerant 200.

As described above, according to the present example embodiment, even when the heat receiving unit of the cooling device is tilted, cooling can be uniformly performed.

Third Example Embodiment

Figure 11:
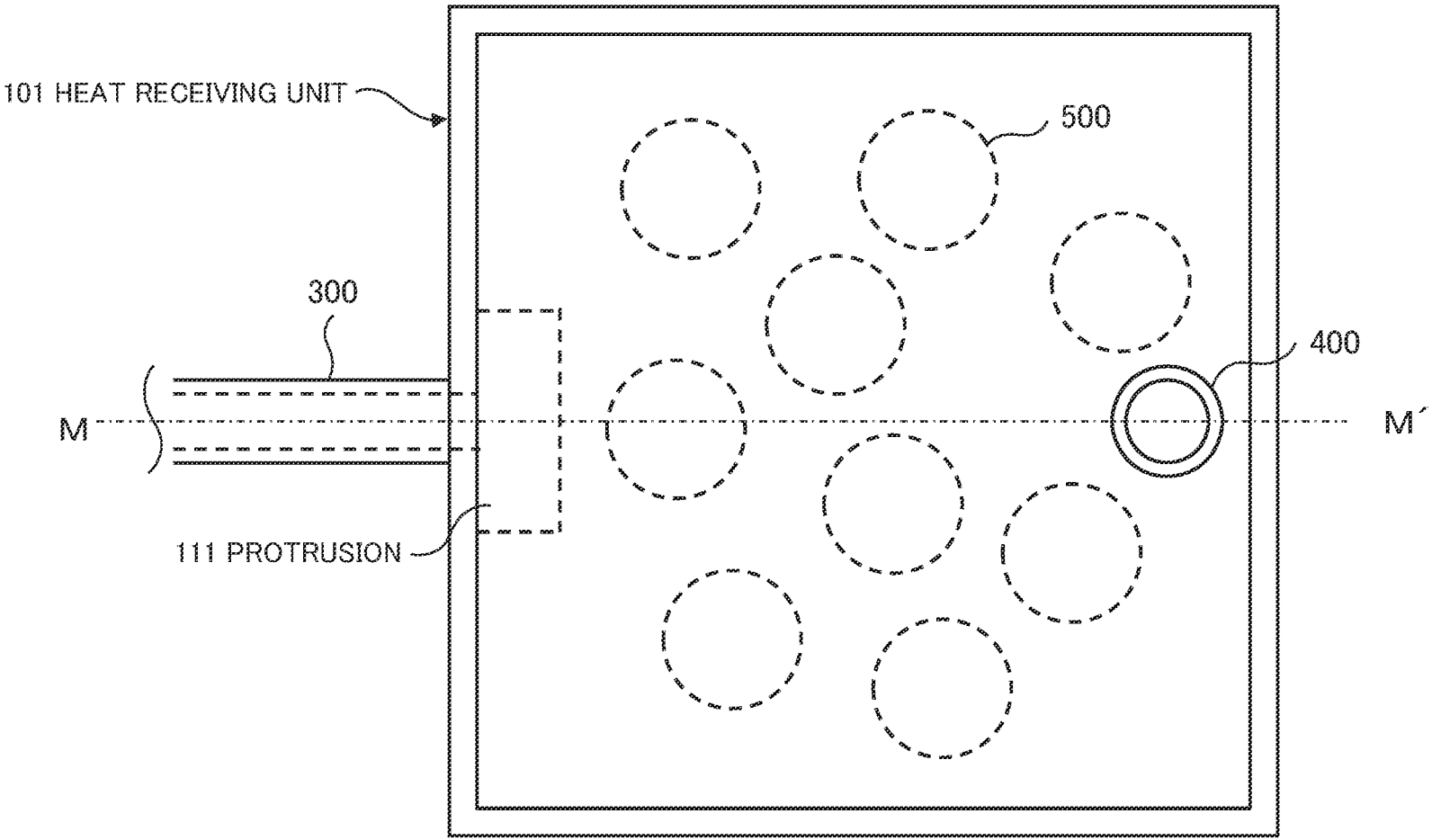
FIG. 11 is a plan view illustrating a heat receiving unit according to a third example embodiment.
Figure 12:
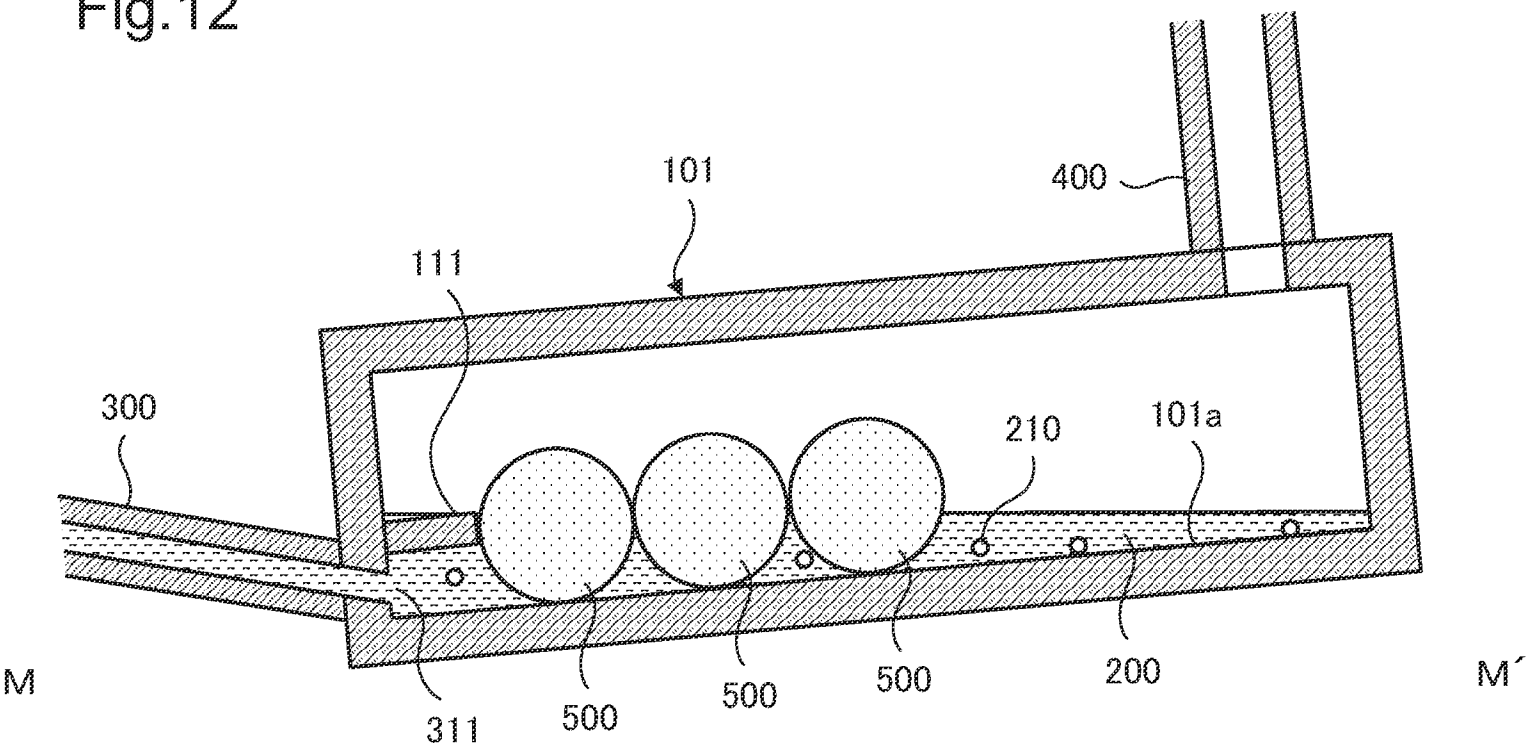
FIG. 12 is a cross-sectional view illustrating a state in which the heat receiving unit according to the third example embodiment is tilted.

FIG. 11 is a plan view illustrating a heat receiving unit 101 according to a third example embodiment. FIG. 12 is a cross-sectional view taken along a line M-M' in FIG. 11. As illustrated in FIG. 11, a plurality of spherical spacers 500 similar to those of the second example embodiment are enclosed inside the heat receiving unit 101. Further, as illustrated in FIGS. 11 and 12, in the present example embodiment, an internal space of the heat receiving unit 100 has a rectangular prism shape. A protrusion 111 is formed into a rectangular shape when viewed from an upper surface. In this example, the internal space of the heat receiving unit 101 is formed in a rectangular prism shape, but may be formed in a polygonal prism shape other than the rectangular prism.

As illustrated in FIG. 12, when the heat receiving unit 101 is tilted in such a way that a side of a liquid phase piping 300 becomes lower, the spacer 500 moves to the liquid phase piping 300 side. In this case, a liquid surface rises, and a liquid phase refrigerant 200 spreads to a boiling portion 101*a* tilted to a higher side, similarly to the second example embodiment. The protrusion 111 restricts movement of the spacer 500, whereby the liquid phase refrigerant 200 is smoothly supplied from a liquid phase piping port 311 to inside of the heat receiving unit 101.

By the operation as described above, it is possible to perform phase change cooling with good uniformity over the entire surface of the boiling portion.

Fourth Example Embodiment

Figure 13:
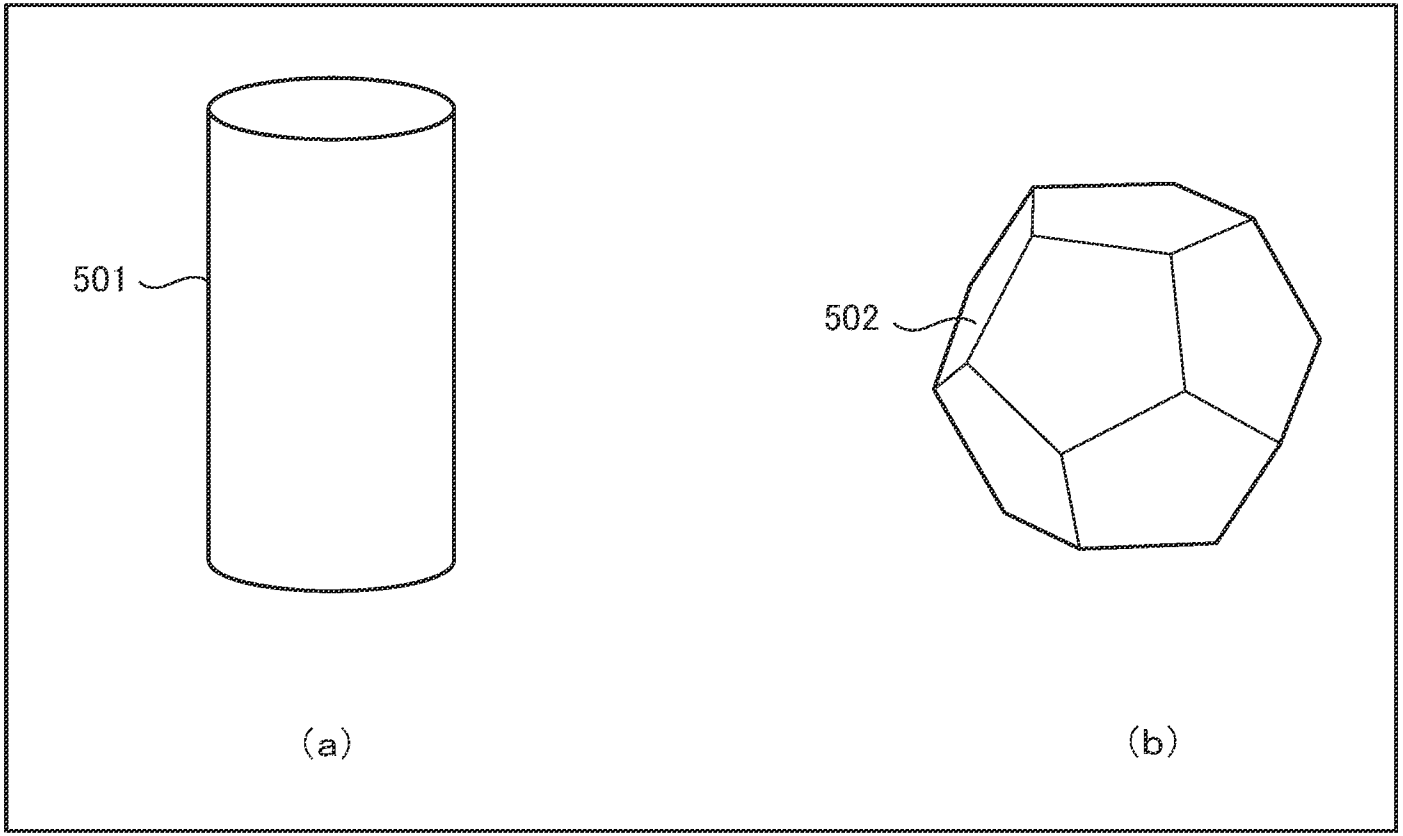
FIG. 13 is a perspective view illustrating a spacer according to a fourth example embodiment.

In the first to third example embodiments, description has been made by using an example in which a spacer has a spherical shape, but a shape other than a spherical shape may be used as long as the spacer can smoothly move along a boiling portion inside a heat receiving unit. For example, a spacer 501 may have a cylindrical shape as illustrated in FIG. 13(*a*), or a spacer 502 may have a polyhedron shape as illustrated in FIG. 13(*b*).

As described above, according to the present example embodiment, similarly to the second and third example embodiments, it is possible to configure a spacer which can be utilized for performing uniform cooling of the heat receiving unit.

While the invention has been particularly shown and described with reference to exmple embodiments thereof, the invention is not limited to these embodiments. It will be understood by those of ordinary skill in the art that various changes in form and details may be made therein without departing from the spirit and scope of the present invention as defined by the claims.

This application is based upon and claims the benefit of priority from Japanese patent application No. 2018-242159, filed on Dec. 26, 2018, the disclosure of which is incorporated herein in its entirety by reference.

REFERENCE SIGNS LIST

1, 100 Heat receiving unit
2, 200 Liquid phase refrigerant
3, 300 Liquid phase piping
4, 400 Gas phase piping
5, 500, 501, 502 Spacer
110 Protrusion
210 Gas phase refrigerant
310 Liquid phase piping port
410 Gas phase piping port
1000 Cooling device
2000 Heating element

What is claimed is:

1. A cooling device comprising:

a heat receiving unit having a space for holding a refrigerant inside;

a liquid phase piping that supplies a liquid phase refrigerant to the heat receiving unit;

a gas phase piping that discharges a gas phase refrigerant from the heat receiving unit; and a spacer being disposed inside the heat receiving unit, wherein the spacer has a higher specific gravity than the liquid phase refrigerant, and has a shape for moving downward along an inner bottom surface of the heat receiving unit and pushing up a liquid surface of the liquid phase refrigerant when the heat receiving unit is tilted.

2. The cooling device according to claim 1, further comprising a heat radiating unit that cools and liquefies the gas phase refrigerant being recovered from the gas phase piping, and delivers the liquefied liquid phase refrigerant to the liquid phase piping, the heat radiating unit forming a closed flow path.

3. The cooling device according to claim 2, wherein a protrusion for restricting movement of the spacer is provided in a vicinity of a liquid phase refrigerant supply port being provided in a connecting portion between the liquid phase piping and the heat receiving unit, in such a way as to prevent the spacer from blocking the liquid phase refrigerant supply port.

4. The cooling device according to claim 3, wherein the protrusion is provided at a height of ½ or more and less than 1 times of an outer shape of the spacer from a bottom surface inside the heat receiving unit.

5. The cooling device according to claim 2, wherein the internal space of the heat receiving unit is cylindrical.

6. The cooling device according to claim 2, wherein the spacer is spherical.

7. The cooling device according to claim 2, wherein the spacer is a polyhedron.

8. The cooling device according to claim 1, herein a protrusion for restricting movement of the spacer is provided in a vicinity of a liquid phase refrigerant supply port being provided in a connecting portion between the liquid phase piping and the heat receiving unit, in such a way as to prevent the spacer from blocking the liquid phase refrigerant supply port.

9. The cooling device according to claim 8, wherein the protrusion is provided at a height of ½ or more and less than 1 times of an outer shape of the spacer from a bottom surface inside the heat receiving unit.

10. The cooling device according to claim 9, wherein the internal space of the heat receiving unit is cylindrical.

11. The cooling device according to claim 9, wherein the spacer is spherical.

12. The cooling device according to claim 8, wherein the internal space of the heat receiving unit is cylindrical.

13. The cooling device according to claim 8, wherein the spacer is spherical.

14. The cooling device according to claim 1, wherein the internal space of the heat receiving unit is cylindrical.

15. The cooling device according to claim 14, wherein the spacer is spherical.

16. The cooling device according to claim 1, wherein the spacer is spherical.

17. The cooling device according to claim 1, wherein the spacer is a polyhedron.

18. The cooling device according to claim 1, wherein, when the heat receiving unit is viewed from above, a total area occupied by the spacer is ¼ or more and less than ½ of a bottom area inside the heat receiving unit.

19. A manufacturing method for a cooling device, the method comprising:

forming a closed flow path by using a heat receiving unit having a space for holding a refrigerant inside, a liquid phase piping that supplies a liquid phase refrigerant to the heat receiving unit, a gas phase piping that discharges a gas phase refrigerant from the heat receiving unit, and a heat radiating unit that cools and liquefies the gas phase refrigerant being recovered from the gas phase piping, and delivers the liquefied liquid phase refrigerant to the liquid phase piping; and disposing, inside the heat receiving unit, a spacer having a higher specific gravity than the liquid phase refrigerant, and having a shape for moving downward along an inner bottom surface of the heat receiving unit and for pushing up a liquid surface of the liquid phase refrigerant when the heat receiving unit is tilted.

20. The manufacturing method for a cooling device according to claim 19, wherein the spacer is spherical.

* * * * *